US006244896B1

(12) United States Patent
Boutros

(10) Patent No.: US 6,244,896 B1
(45) Date of Patent: Jun. 12, 2001

(54) DUAL MULTIPORT RJ CONNECTOR ARRANGEMENT

(75) Inventor: Kamal Shawiky Boutros, Richmond Hill (CA)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 09/517,309

(22) Filed: Mar. 2, 2000

Related U.S. Application Data

(62) Division of application No. 09/255,854, filed on Feb. 23, 1999.

(51) Int. Cl.[7] ..... H01R 13/60; H01R 13/66

(52) U.S. Cl. ..... 439/541.5; 439/607

(58) Field of Search ..... 439/541.5, 607, 439/701, 676

(56) References Cited

U.S. PATENT DOCUMENTS

| | | | |
|---|---|---|---|
| Re. 36,065 | * | 1/1999 | Andrews et al. ..... 439/608 |
| 4,612,602 | | 9/1986 | Weyer et al. . |
| 5,288,251 | | 2/1994 | Sumida . |
| 5,322,447 | | 6/1994 | Okada . |
| 5,531,621 | | 7/1996 | Goodall et al. . |
| 5,562,507 | | 10/1996 | Kan . |
| 5,639,267 | | 6/1997 | Loudermilk . |
| 5,704,802 | | 1/1998 | Loudermilk . |
| 5,709,554 | | 1/1998 | Savage, Jr. . |
| 5,775,946 | | 7/1998 | Briones . |
| 5,938,481 | | 8/1999 | Okabe et al. . |

* cited by examiner

*Primary Examiner*—Tulsidas Patel
*Assistant Examiner*—Hae Moon Hyeon
(74) *Attorney, Agent, or Firm*—Blank Rome Comisky & McCauley, LLP

(57) ABSTRACT

A dual connector arrangement made up of two discrete multiport connectors, each with an external shield, that may be vertically stacked, the first of the two connectors being a conventional single row multiport connector, and the second of the two connectors being a single row multiport connector with a vertical extension that houses a single row of contact tails and that fits behind the first multiport connector and shields the contact tails of the second multiport connector when it is seated on top of the first multiport connector.

14 Claims, 2 Drawing Sheets

DUAL MULTIPORT RJ CONNECTOR ARRANGEMENT

This application is a Divisional of non-provisional application Ser. No. 09/255,854, filed Feb. 23, 1999.

BACKGROUND OF THE INVENTION

1. Field of the Invention

This invention relates to the field of electrical connectors, and in particular to an arrangement for providing multiple rows of input/output ports on a printed circuit board or interface card without the need for a stacked multiport connector having an internal shield. The invention also relates to an arrangement for installing a plurality of single row multiport modular jack connectors on a printed circuit board or interface card to form a high density multiport connector array, and to connectors that permit such stacking.

2. Description of Related Art

Electrical connectors known as modular phone receptacles or jacks have been available for many years. Although connectors of this type were originally designed for use in telephone systems, they have found wide acceptance in a variety of other contexts. For example, modular jacks referred to as RJ connectors, which may be incorporated into single port or multiport arrangements, are now commonly used as input/output (I/O) interface connectors for enabling computers to communicate with each other and with a variety of peripheral equipment, and in particular as connectors between a local area network (LAN) and an appropriately configured interface card.

In order to receive a corresponding modular plug, the conventional modular jack or RJ connector is generally made up of a socket housing which includes a plug-receiving opening, opposed top and bottom surfaces joined by opposed side surfaces extending from the opening to a back surface, and a plurality of stamped, metallic elongated contacts mounted in the housing for engaging contacts of the corresponding plug. Each contact in this type of connector includes a contact mating portion at one end extending diagonally into the socket, a vertically extending lead portion at the other end, and a horizontally extending intermediate portion between the contact mating portion and the lead portion. Generally, the lead portions of the contacts are inserted directly into openings in the interface card and soldered in place.

U.S. Pat. No. 5,775,946 (Briones), herein incorporated by reference, discloses a shielded multiport connector having a row of ports capable of receiving RJ-type connector plugs. The connector disclosed in this patent, which is illustrated in FIGS. 1A–1C, uses a single molded housing having multiple openings and a one-piece external shield in order to increase port density without significantly increasing assembly costs.

In particular, as illustrated in FIGS. 1A–1C, the conventional single row multiport RJ connector includes a molded plastic housing 1 and an external shield 2. Molded plastic housing 1 includes a plurality of ports or receptacle openings 3 (shown in FIG. 1B) each accommodating a plurality of contacts 4 including mating portions 5 that extend into the openings to mate with corresponding contacts of an RJ plug connector, intermediate portions (not shown) that extend rearwardly out of the openings, and contact tails 6 that extend vertically from the intermediate portions through the bottom of the connector to be terminated to a circuit board on which the connector is mounted by, for example, mounting posts 7.

Shield 2 is fitted over the housing 1 following assembly of the contacts 4 to the connector and may be secured to the housing in a variety of ways. As illustrated, the shield 2 is a one-piece shield that includes a foldable rear panel 8 that fits over the back of the housing and that includes horizontal extensions 9 from which project latching tabs 10 that engage openings 11 in the bottom of the housing and cooperate with an inwardly extending lower front panel 12 as described in U.S. Pat. No. 5,775,946 to secure the shield directly to the housing, although the present invention may also be applied, by way of example, to one-piece shields in which the foldable rear panel is secured to adjacent side panels of the shield, rather than directly to the housing, and the adjacent panels are secured to the housing, or to shields made up of separate panels. Extending from the shield are circuit board ground tabs 13 and various optionally arranged side, top, and/or bottom ground tabs 14 for engaging a panel and ground tabs 15 for engaging shields of respective RJ plug connectors inserted into openings 3.

As is apparent from FIG. 1B, the openings for the plug connectors are asymmetric. The tops of the openings include notches 16 arranged to receive latching members on the mating RJ plug connectors, and the space remaining at the corners of the housing adjacent the notches may, if required, be utilized to receive LED indicator lights 17 whose terminals 18 extend to the rear and downward in the same manner as the contacts. Although illustrated with the notches at the top of the connector, the orientation of the ports may also be reversed so that the notches and LEDs are located at the bottom of the connector.

In order to further increase port density while maintaining substantially the same footprint on the circuit board, it is known to modify the single row connector by adding a second row of ports, the top and bottom rows of ports all being enclosed by a single common external shield. Examples are disclosed in U.S. Pat. Nos. 5,531,612 (Goodall), 5,562,507 (Kan), 5,639,267 (Loudermilk), as well as in commonly assigned U.S. patent application Ser. No. 09/149,567, filed Sep. 9, 1998.

The adjacent rows of ports in these connectors generally have vertically symmetric orientation, i.e., the notches 16 are at the bottom and top of the connector, in order to minimize the height of the connectors and to prevent the latches in adjacent rows from facing each other, which would make removal of mating plug connectors difficult. As a result, however, the contacts in adjacent rows are close together, resulting in cross-talk between the facing contacts, and necessitating that a shield be placed between the contacts. The difficulty in assembling the contacts and shields to the housing has led to a number of different approaches to stacked multiport connector design, including the modular approach taken in U.S. patent application Ser. No. 09/149,567, but all such designs represent an increase in connector complexity and also in assembly difficulty, that is disproportionate to the increased port density obtained by stacking the rows of the connector.

In addition, because the conventional multiple row multiport connector has a larger number of pins than the conventional single row connector, the number of pins that must be located or aligned with corresponding openings on the circuit board is correspondingly greater, increasing the difficulty of assembling the connector to the circuit board.

SUMMARY OF THE INVENTION

It is accordingly a first objective of the invention to provide an arrangement that permits the number of input/output or communications ports on a printed circuit board or card to be increased, relative to the number provide by a conventional single row multiport connector, without substantially increasing the footprint of the ports on the circuit card, and without requiring the internal shielding or assembly difficulties of a stacked multiport connector.

It is a second objective of the invention to provide a multiport RJ connector arrangement for a printed circuit board or card that utilizes two discrete stackable connectors rather than a single stacked multiport connector, and which therefore allows additional rows to be retrofitted onto and existing connector.

It is a third objective of the invention to provide a multiport connector for a printed circuit board or card that can be added to an existing multiport connector arrangement to optionally double the number of ports provided by the existing multiport connector and yet that is no more difficult to install than the existing multiport connector.

These objectives are achieved, in accordance with the principles of a preferred embodiment of the invention, by providing a dual connector system made up of two discrete multiport connectors, each with an external shield, that may be vertically stacked, the first of the two connectors being a conventional single row multiport connector, and the second of the two connectors being a single row multiport connector with a vertical extension that houses a single row of contact tails and that fits behind the first multiport connector and protects the contact tails of the second multiport connector when it is seated on top of the first multiport connector, the external shield of the first multiport connector shielding the contacts of the first connector from those of the second connector.

The principles of the preferred embodiment of the invention are also implemented by providing an L-shaped multiport connector corresponding to the second multiport connector of the dual connector system, and which can be fitted on top of an existing multiport connector to increase the number of ports available in substantially the same footprint as the first multiport connector.

It will be appreciated by those skilled in the art that the above-described arrangement simplifies assembly of the individual connectors by eliminating the need for internal shielding because it is easier to fit an external shield onto a connector than to insert an internal shield. In addition, assembly of the connectors to the circuit board is facilitated because only a single row of pins needs to be aligned for each of the two connectors, it being easier to align a connector having a single row than one having multiple rows of contact tails.

Although the preferred embodiments of the invention are directed in particular to RJ type modules and connectors, such as a high speed RJ-45 connector of the type typically used on network or communications interface cards, it will be appreciated by those skilled in the art that the principles of the invention could possibly be used in other types of multiple port printed circuit board connectors.

DETAILED DESCRIPTION OF THE PREFERRED EMBODIMENTS

Figure 2:
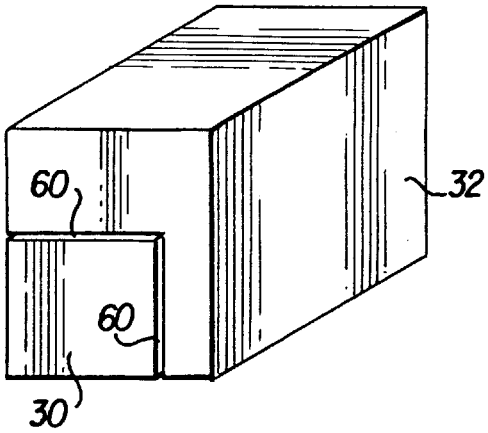
FIG. 2 is an isometric schematic view of a dual connector arrangement constructed in accordance with the principles of a preferred embodiment of the invention.
Figure 3:
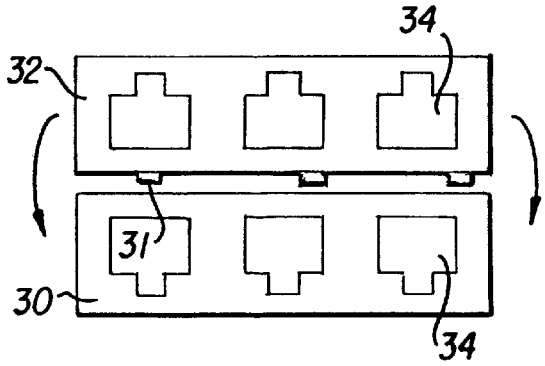
FIG. 3 is a front view of the connector of FIG. 2.
Figure 4:
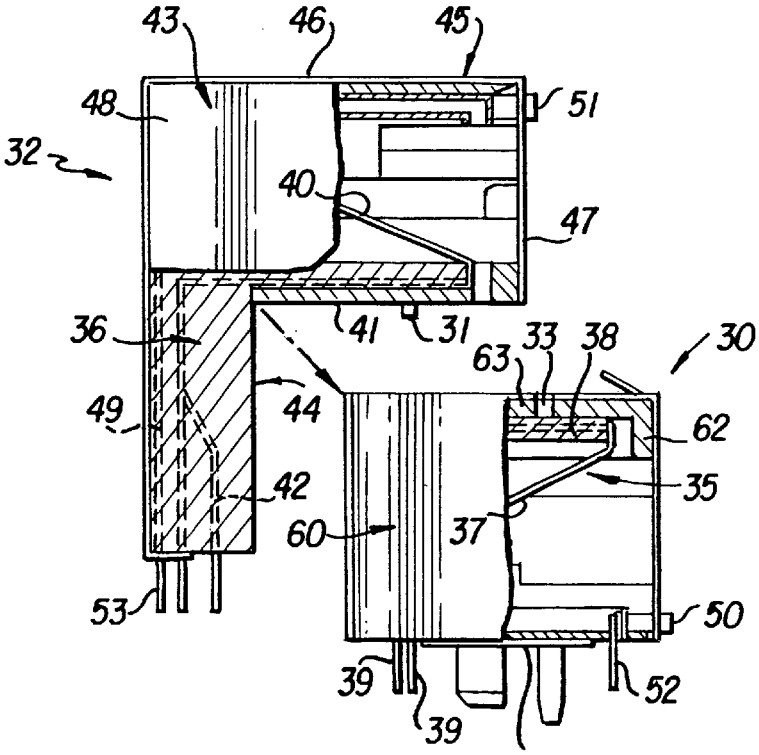
FIG. 4 is a partially cross-sectional side view of a specific implementation of the dual connector arrangement of FIGS. 2 and 3.

As illustrated in FIGS. 2 and 3, the dual connector arrangement or system of the preferred embodiment of the invention offers a substitute for conventional stacked multiport connectors in which, instead of providing a single connector housing with an internal shield between the rows of connector ports, two connectors are provided, the external shield of one connector electrically shielding the contacts of the two connectors so as to prevent cross-talk between the contacts.

Figure 1A:
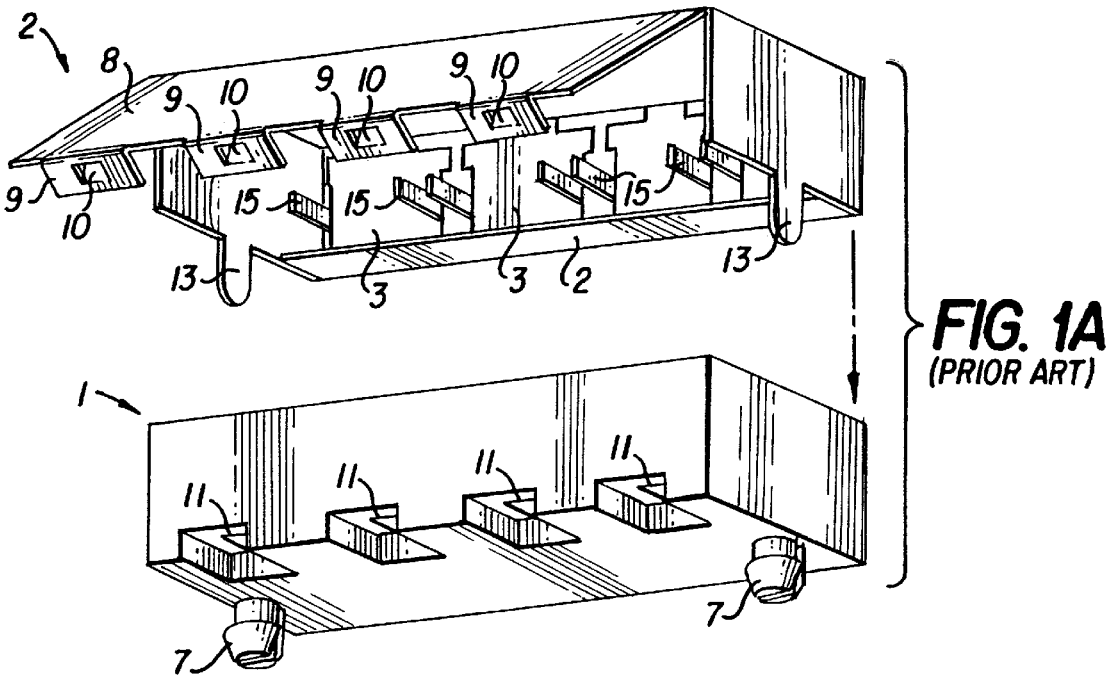
FIG. 1A (PRIOR ART)
FIG. 1A is an isometric view of a conventional single row multiport RJ connector.
Figure 1B:
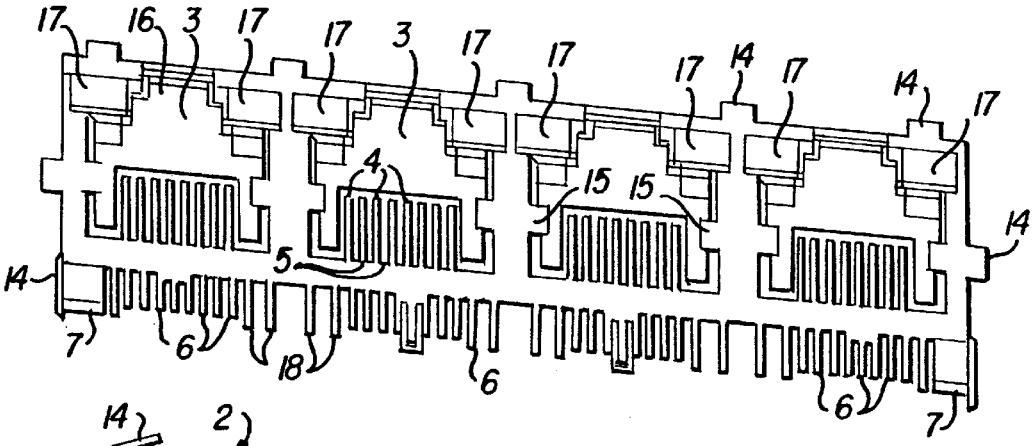
FIG. 1B (PRIOR ART)
FIG. 1B is a front view of the connector of FIG. 1A.
Figure 1C:
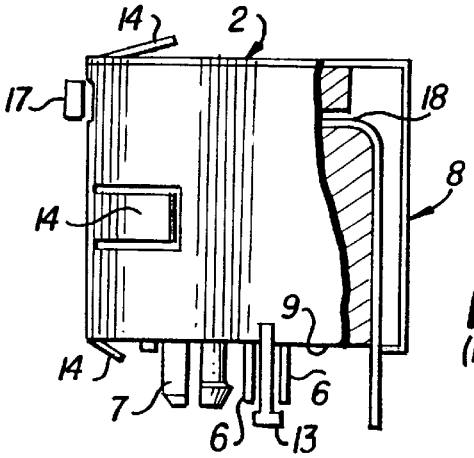
FIG. 1C (PRIOR ART)
FIG. 1C is a cross-sectional side view of the connector of FIGS. 1A and 1B.

One of the connectors is a single row multiport connector 30 having an external shield, which may be identical to the conventional single row multiport connector illustrated in FIGS. 1A–1C, or any other conventional single row multiport connector, except that alignment elements 31 are provided at or near the top of the connector. The other one of the two connectors is a single row multiport connector 32, which may be similar in construction to the conventional multiport connectors, but which is extended rearwardly and downwardly as illustrated in FIG. 2 to fit over the lower connector 1, and which includes alignment elements 33, as illustrated in FIG. 3.

Alignment elements 31 and 33 may respectively be in the form of pins extending downwardly from a lower surface of upper connector 32, and complementary recesses in the top surface of connector 30, or may take any other form which enables the elements to be used to position or align the lower connector relative to the upper connector. It is also possible to omit either or both of elements 31 and 33, although having built-in alignment elements will in general facilitate assembly of the upper connector to the lower connector. The number and arrangement of the alignment elements, if included, is of course optional.

Because the lower connector 30 is shielded in conventional fashion by means of an external shield 60 corresponding to shield 2 shown in FIGS. 1A–1C, it is not necessary to provide an internal shield between the rows of ports 34. Instead, the two connectors are assembled in the same way that conventional single row multiport connectors lacking an internal shield are assembled, and may be sold together or separately, and may be mounted to a circuit board at the same or different times.

As in the connector illustrated in FIGS. 1A–1C, the lower multiport connector includes a housing having a bottom wall 61 that faces the circuit board, and walls 62, including front, back, and side walls that extend upwardly from the bottom wall 61 to a top wall 63 that is substantially parallel to the bottom wall. External shield 60 of the lower connector covers principal surfaces of the front, back, and side walls.

The lower multiport connector 30 is installed on the circuit board first, and the upper multiport connector 32 may be installed at any time afterwards, or added to an existing already-installed connector. Installation of the upper connector 32 simply involves positioning of the upper connector relative to the lower connector while inserting the contacts tails extending from the connector, and electrically connecting the contact tails to the openings in a conventional manner. The contact tails of the lower and upper connector may be pin contact tails arranged to be inserted into openings in the circuit board, or one or both of the lower and upper connectors may include surface-mount or other types of contact tails. Positioning and electrical connection of the contact tails completes the dual connector arrangement, providing two rows of ports. The rows of ports may be arranged, if desired, to be identical in configuration, spacing, and number, to those of a more complicated and higher cost stacked multiport connector.

As shown in FIG. 3, the lower and upper connectors 30,32 each include contacts 35,36 having respective mating, intermediate, and tail sections 37–39 and 40–42. The only difference between the contacts 35 of the lower connector 30 and the contacts 36 of the upper connector 31 is that the intermediate sections 41 of the upper connector are extended rearwardly, and the tail sections 42 of the upper connector are extended downwardly, to accommodate the lower connector. In conventional stacked multiport connectors, the corresponding sections of the upper row of contacts are also extended rearwardly and downwardly, and the configuration of the contacts in the upper connector 32 may thus be similar or identical to the configuration of the upper contacts in the stacked multiport connector.

To accommodate the extended contacts 36 of the upper connector 31, upper connector 32 is itself extended rearwardly and downwardly to form and inverted L-shape having a horizontal port section 43 and a vertical section 44, which may be formed together as a single housing. As a result, the external shield 45 for the upper connector preferably also has an inverted L-shaped cross-section, including a planar top panel 46, a conventionally configured front panel 47 with openings for the ports, L-shaped side panels 48, and a planar rear panel 49 for respectively covering top, front, side, and rear walls of the upper connector housing. Rear panel 49 may be a foldable panel similar to rear panel 8 shown in FIGS. 1A and 1C, so that installation of the upper connector shield is accomplished in the same manner as is the case for the conventional single row multiport connector.

Although the stacked connector arrangement could possibly be tiered, it is preferred that the front surface of the top connector be substantially flush with the front surface of the lower connector upon assembly of the upper connector to the lower connector. From the point of view of a user of the assembled connectors, the two discrete connectors are indistinguishable from a stacked multiport connector.

The illustrated dual connector arrangement may also include, if required, indicator lights 50,51 having leads 52,53 in the form of light emitting diodes positioned adjacent the RJ plug connector openings. The manner in which the indicator lights are mounted may be identical to those of the prior art, except that the leads 53 of the upper connector indicator lights 51 may be extended in a manner similar to the upper connector contacts.

While the upper connector is illustrated as having an inverted L-shaped housing, it will be appreciated that the shaped of the upper housing could be varied within the overall inventive concept of stacking two single row multiport connectors, so long as the upper connector fits over the lower connector, and the leads of the upper connector are separated from those of the lower connector by an external shield on the lower connector. In addition, those skilled in the art will appreciate that the number of ports, specific contact configurations, and the like may be freely varied without departing from the scope of the invention.

Thus, having described preferred embodiments of the invention with sufficient particularity to enable those skilled in the art to easily make and use the invention, and having described several possible variations and modifications of the preferred embodiment, it should nevertheless be appreciated that still further variations and modifications of the invention are possible, and that all such variations and modifications should be considered to be within the scope of the invention.

I claim:

1. A dual multiport electrical connector arrangement, comprising:

a first multiport connector arranged to be mounted on a circuit board, said first multiport connector including a first housing having a bottom wall that faces the circuit board, and front, back, and side walls extending upwardly from the bottom wall to a top wall that is substantially parallel to the bottom wall;

an external shield that covers the surfaces of said front, back, side, top but not bottom walls of said first multiport connector;

a second multiport connector arranged to be positioned above said first multiport connector, said first and second multiport connectors each including electrical contacts extending rearwardly from openings in the front walls of the connectors, and downwardly so as to be terminated to the circuit board, wherein said electrical contacts of said first multiport connector are electrically shielded from contacts of said second multiport connector by said external shield of said first multiport connector, and wherein said first and second multiport connectors are multiport RJ connectors and said second multiport connector is positioned on said first multiport connector to form a stacked multiport RJ connector.

2. An arrangement as claimed in claim 1, wherein said second multiport connector includes a housing and an external shield that covers side, rear, and top walls of the housing, and wherein a bottom wall of the housing that faces said first multiport connector when said second multiport connector is positioned on said first multiport connector is unshielded.

3. An arrangement as claimed in claim 2, wherein said second multiport connector housing includes a front portion containing said ports, and a rear extension which extends behind the first multiport connector to the circuit board when the second multiport connector is fitted over the first multiport connector, in which position the front wall of said second housing is substantially flush with the front wall of the first multiport connector.

4. An arrangement as claimed in claim 1, wherein said second multiport connector comprises a housing having a front portion containing a plurality of ports, and a rear extension which extends behind the first multiport connector to the circuit board when the second multiport connector is fitted over the first multiport connector, in which position the front wall of said second housing is substantially flush with the front wall of the first multiport connector.

5. An arrangement as claimed in claim 1, further comprising positioning elements on at least one of the first and second multiport connectors for positioning the second multiport connector relative to the first multiport connector.

6. An arrangement as claimed in claim 5, wherein said positioning elements include complementary interengaging elements each of said first and second multiport connectors.

7. An arrangement as claimed in claim 6, wherein said complementary interengaging elements including at least one pin extending from the bottom surface of said second multiport connector, and at least one recess in a wall of said first multiport connector.

8. An arrangement as claimed in claim 1, wherein said first and second multiport connectors are multiport RJ connectors, each having a single row of ports.

9. An upper multiport electrical connector arranged to be fitted on top of a lower multiport electrical connector that has been mounted to a circuit board;

said lower multiport connector including a lower housing having a bottom wall that faces the circuit board, and front, back, and side walls extending upwardly from the bottom wall to a top wall that is substantially parallel to the bottom wall, and an external shield that covers surfaces of said front, back, side, top, but not bottom walls;

said upper multiport connector comprising an upper housing that includes a front portion containing ports, and a rear extension which extends behind the lower multiport connector to the circuit board when the upper multiport connector is fitted over the lower multiport connector, and an external shield that covers side, rear, and top walls of the housing;

wherein when said upper multiport connector is positioned on said lower multiport connector, a stacked RJ connector is formed.

10. A connector as claimed in claim 9, wherein a front wall of the upper multiport connector is substantially flush with the front wall of the lower multiport connector, so that when the upper multiport connector is positioned on the lower multiport connector, the upper and lower multiport connectors have a front face that corresponds to that of a stacked multiport connector having multiple rows of ports.

11. A connector as claimed in claim 9, wherein a bottom wall of the upper multiport housing that faces said lower multiport connector is unshielded when said upper multiport connector is positioned on said lower multiport connector.

12. An arrangement as claimed in claim 9, further comprising a positioning element on a portion of a bottom surface of said upper multiport connector that faces a top of said lower multiport connector when said upper multiport connector is positioned on said lower multiport connector.

13. An arrangement as claimed in claim 12, wherein said positioning element is a pin extending from the bottom surface of said upper multiport connector, and arranged to be received in a recess in a top wall of the lower multiport connector.

14. An arrangement as claimed in claim 1, wherein said upper multiport connector is a multiport RJ connector having a single row of ports.

* * * * *

UNITED STATES PATENT AND TRADEMARK OFFICE

CERTIFICATE OF CORRECTION

PATENT NO. : 6,244,896 B1
DATED : June 12, 2001
INVENTOR(S) : Boutros

It is certified that error appears in the above-identified patent and that said Letters Patent is hereby corrected as shown below:

Column 2,
Line 67, change “provide” to -- provided --.

Column 3,
Line 9, change “and” to -- an --.

Column 5,
Line 22, change “31,” to -- 32, --.
Line 54, change “shaped” to -- shape --.

Signed and Sealed this

Twenty-third Day of December, 2003

JAMES E. ROGAN
*Director of the United States Patent and Trademark Office*